US009809000B2

(12) United States Patent
Kubo

(10) Patent No.: US 9,809,000 B2
(45) Date of Patent: Nov. 7, 2017

(54) SHEET BINDING PROCESSING APPARATUS AND POST-PROCESSING APPARATUS HAVING THE SAME

(71) Applicant: NISCA CORPORATION, Minamikoma-gun, Yamanashi-ken (JP)

(72) Inventor: Mamoru Kubo, Yamanashi-ken (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 196 days.

(21) Appl. No.: 14/886,379

(22) Filed: Oct. 19, 2015

(65) Prior Publication Data

US 2016/0107409 A1 Apr. 21, 2016

(30) Foreign Application Priority Data

Oct. 20, 2014 (JP) ..... 2014-213547

(51) Int. Cl.

| | |
|---|---|
| ***B31F 5/02*** | (2006.01) |
| ***G03G 15/00*** | (2006.01) |
| ***B31F 1/07*** | (2006.01) |
| ***B42F 3/00*** | (2006.01) |
| ***B42B 4/00*** | (2006.01) |
| ***B42B 5/00*** | (2006.01) |

(52) U.S. Cl.

CPC ..... *B31F 5/02* (2013.01); *B31F 1/07* (2013.01); *B42B 4/00* (2013.01); *B42B 5/00* (2013.01); *B42F 3/00* (2013.01); *G03G 15/6541* (2013.01); *G03G 15/6544* (2013.01); *B31F 2201/00* (2013.01); *G03G 2215/00827* (2013.01); *G03G 2215/00848* (2013.01); *G03G 2215/00852* (2013.01)

(58) Field of Classification Search

CPC ..... B31F 1/07; B31F 5/02; B31F 2201/00; B42F 3/00; G03G 2215/00852

USPC ..... 270/58.08; 412/33

See application file for complete search history.

(56) References Cited

U.S. PATENT DOCUMENTS 1,150,805 A * 8/1915 Beran ..... B21D 1/06 101/23
8,333,372 B2 * 12/2012 Awaya ..... B65H 37/04 270/58.07
8,657,596 B2 * 2/2014 Lake ..... B29C 55/18 425/363

(Continued)

FOREIGN PATENT DOCUMENTS

JP 2004135537 A * 6/2004
JP 2010208854 A * 9/2010
JP 2010-274623 A 12/2010

(Continued)

*Primary Examiner* — Leslie A Nicholson, III
(74) *Attorney, Agent, or Firm* — Manabu Kanesaka

(57) ABSTRACT

The present invention is to provide a binding processing apparatus that prevents easy unbinding regardless of thickness of a sheet bundle to be bound and that lessens influence of damage on sheets. In the present sheet binding processing apparatus, a pair of pressurizing faces for pressure-nipping a sheet bundle are formed to have tooth forms each having a convex shape and a concave shape, the tooth forms being engaged with each other along a predetermined tooth width, and the tooth forms are shaped so that an engagement depth between a tooth top and a tooth root is varied along a tooth width direction toward a sheet end edge.

8 Claims, 9 Drawing Sheets

(56) References Cited

U.S. PATENT DOCUMENTS

| | | | | |
|---|---|---|---|---|
| 2006/0243383 | A1* | 11/2006 | Gelli | B31F 1/07<br>156/291 |
| 2012/0148372 | A1* | 6/2012 | Mori | B42B 5/00<br>412/33 |

FOREIGN PATENT DOCUMENTS

| | | | |
|---|---|---|---|
| JP | 2012-047940 | A | 3/2012 |
| WO | WO 2009110298 | A1 * | 9/2009 |

* cited by examiner

FIG. 6A
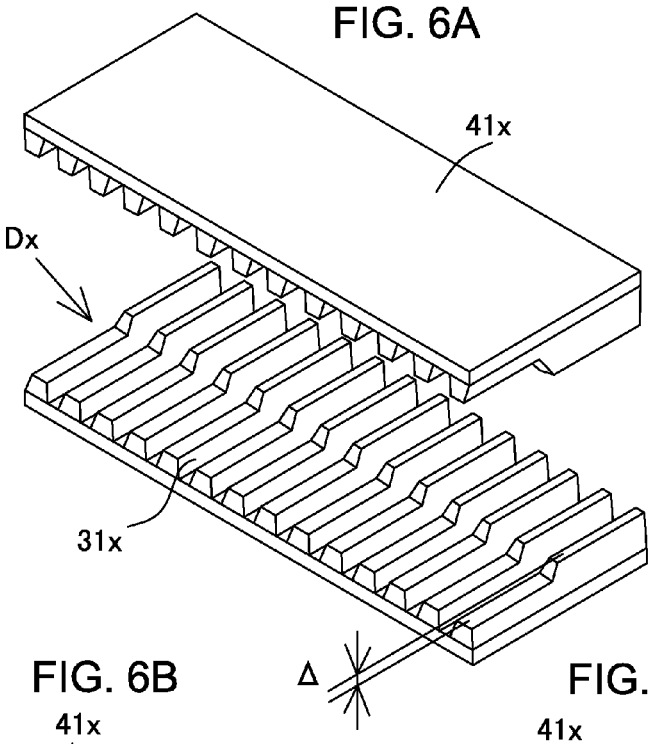
FIG. 6B
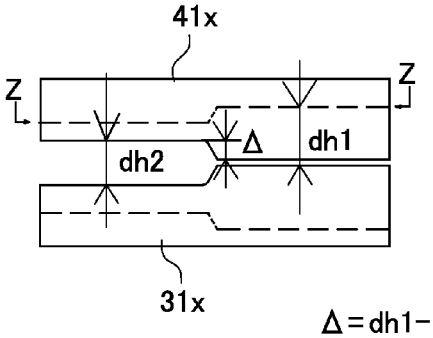
FIG. 6C
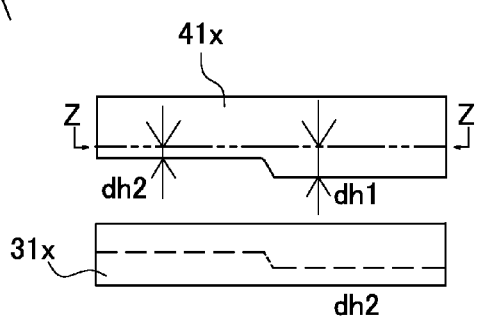
Δ = dh1 − dh2 Z−Z; Engagement tooth top line
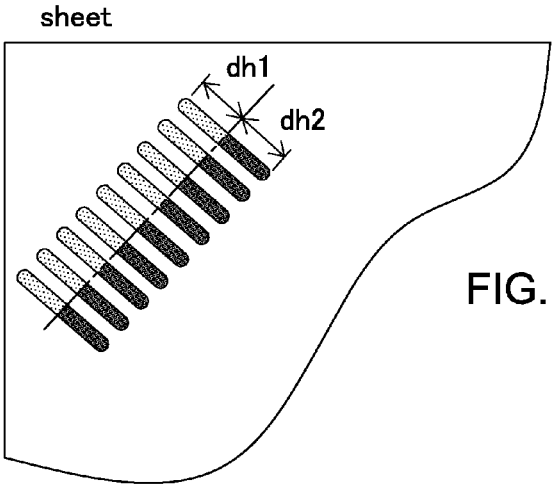
FIG. 6D FIG. 7A
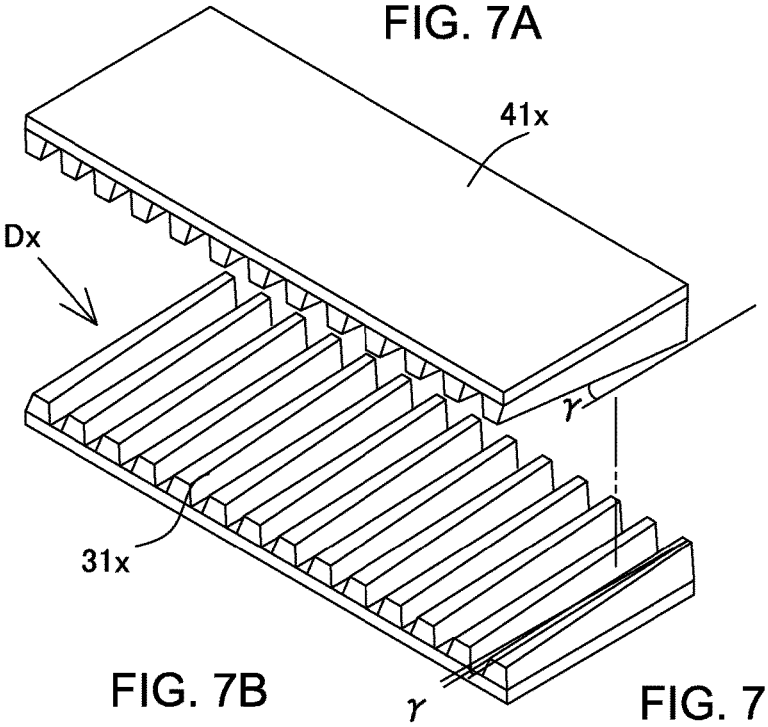
FIG. 7B
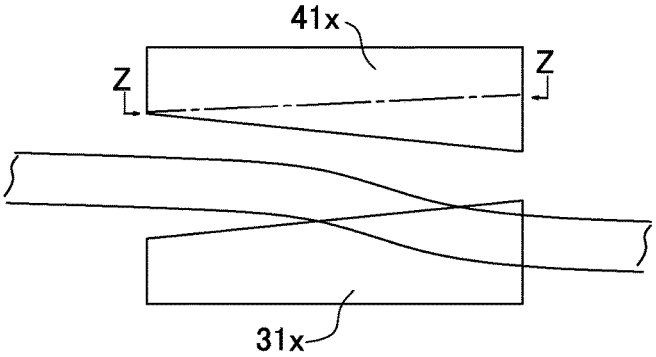
FIG. 7C
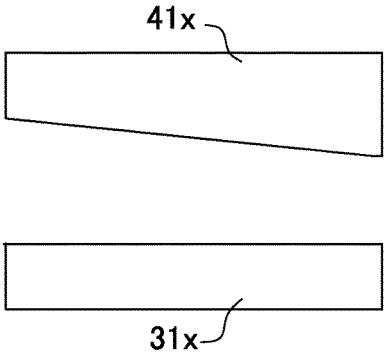
Z−Z; Engagement tooth top line
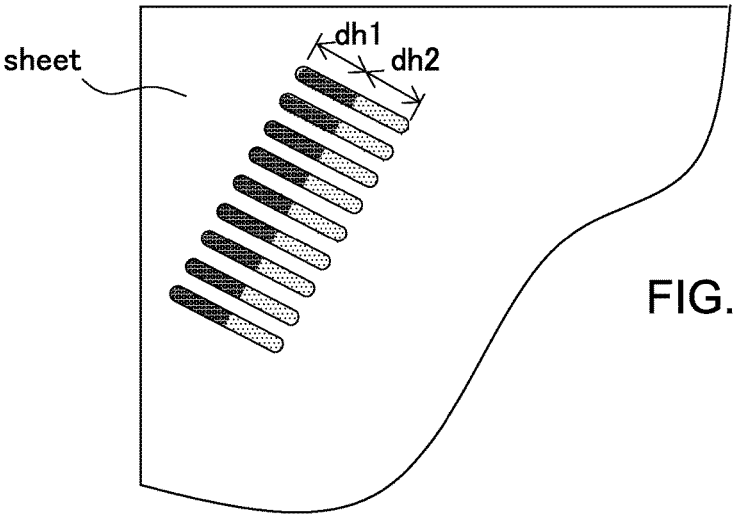
FIG. 7D

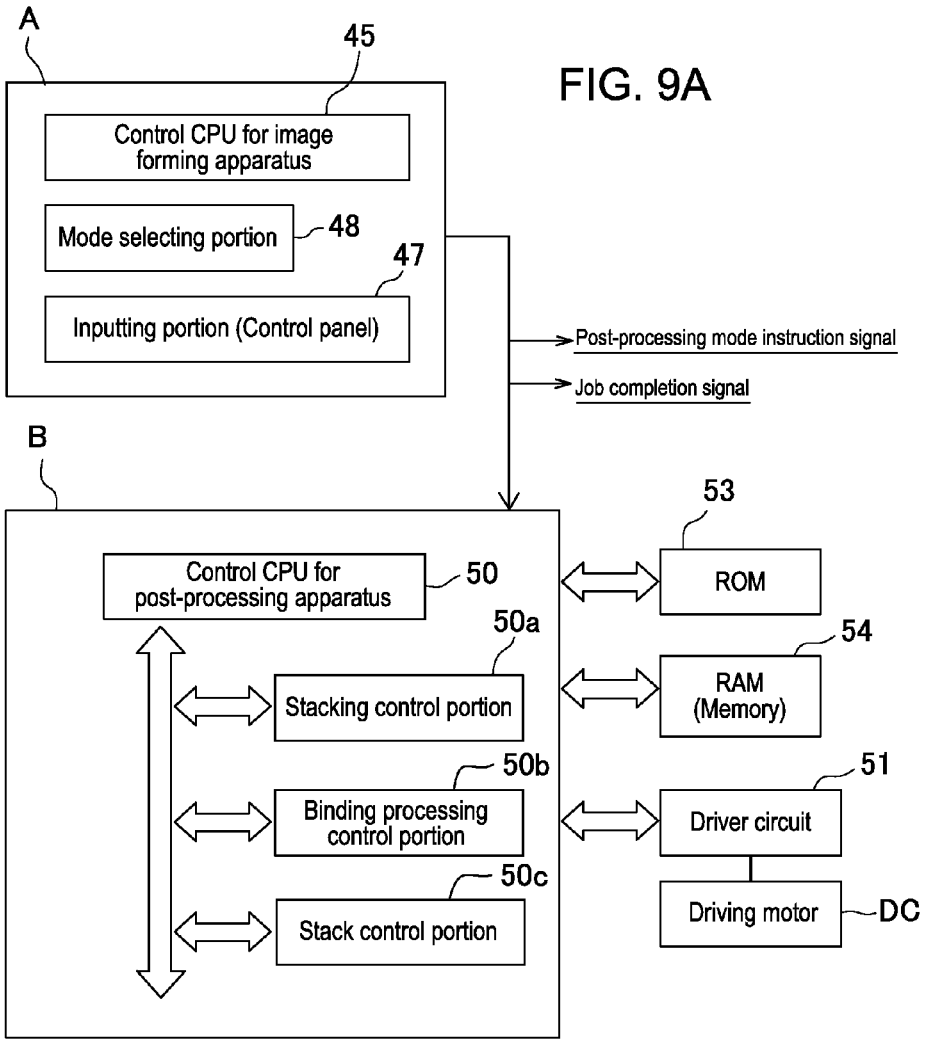
FIG. 9A
FIG. 9B
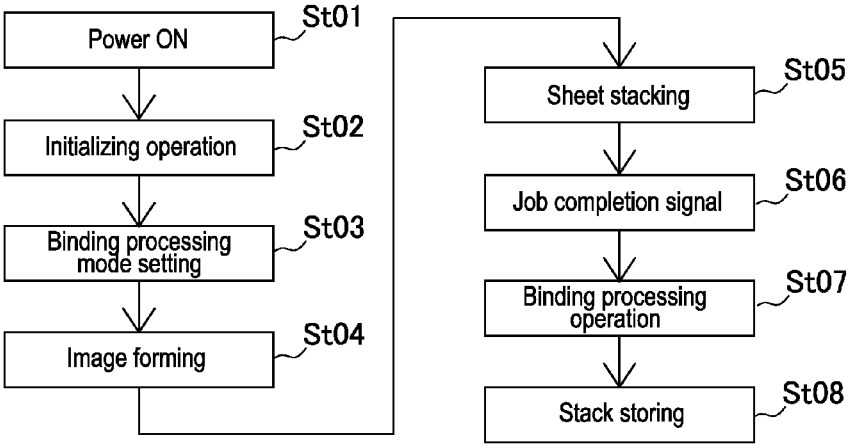

SHEET BINDING PROCESSING APPARATUS AND POST-PROCESSING APPARATUS HAVING THE SAME

RELATED APPLICATIONS

The present application claims priority from Japanese Application No. 2014-213547, filed Oct. 20, 2014, the disclosure of which is hereby incorporated by reference herein in its entirety.

BACKGROUND OF THE INVENTION

1. Field of the Invention

The present invention relates to a sheet binding processing apparatus to bind a plurality of sheets, and relates to improvement of a binding mechanism.

2. Description of Related Arts

In general, such a kind of the binding processing apparatus has been known such as a post-processing apparatus in an image forming system to perform a binding process on a sheet bundle that is supported on a sheet placement base (sheet supporting face). There have been known, as a binding processing mechanism, a mechanism to bind a sheet bundle using a staple (staple binding mechanism) and a mechanism to perform pressure-contact binding on a sheet bundle as pressure-nipping the sheet bundle with pressurizing faces having concave-convex faces (pressure-contact binding mechanism).

The pressure-contact binding mechanism to perform a binding process on a sheet bundle without using a metal staple has been adopted as a binding method that enables the bound sheets to be easily separated to prevent an environmental problem from occurring at the time of document disposal. However, there has been known a problem that sheets are unbound when the sheet bundle is thick, when turning a page rapidly, and the like.

For example, Japanese Patent Application Laid-open No. 2012-47940 proposes an apparatus to perform binding by deforming a plurality of sheets into a corrugation shape in cross-section while tooth forms having a convex shape and a concave shape are formed at a pair of pressurizing members that presses the sheet bundle.

The document discloses a pressurizing mechanism in which a plurality of tooth forms are arranged in line with a tooth width direction being oriented from a sheet center side toward an end edge side.

Further, Japanese Patent Application Laid-open No. 2010-274623 discloses a mechanism in which a plurality of tooth forms having different pressurizing engagement shapes arranged in a replaceable manner and performs binding on a sheet bundle with an engagement shape in accordance with a bundle thickness.

SUMMARY OF THE INVENTION

As a method to perform a binding process on a plurality of sheets without using a staple, there has been known a binding processing mechanism to deform stacked sheets into a gather shape as pressure-nipping the sheets in a front-back direction with pressurizing faces each having concave-convex tooth form. With this binding processing mechanism, there has been a case that a bound sheet bundle is easily unbound. When pressing force is enlarged to obtain strong binding, there arises a problem that sheets are damaged.

Then, Japanese Patent Application Laid-open 2010-274623 proposes to select a pressurizing tooth form in accordance with a sheet bundle while a plurality of tooth forms having different shapes are prepared for a thick sheet bundle as well as for a thin sheet bundle. In this case, there arises a problem that a pressurizing mechanism is complicated and upsized.

In a case that a sheet bundle is to be bound by being pressure-nipped with a pair of pressurizing faces, binding force and damage degree vary in accordance with thickness of a sheet bundle, material difference, and temperature and humidity difference. Accordingly, it is regarded to be difficult to set pressing force into appropriate conditions under which sheets are reliably bound without being damaged.

In view of the above, an object of the present invention is to provide a binding processing apparatus that prevents easy unbinding regardless of thickness of a sheet bundle to be bound and that lessens influence of damage on sheets.

To achieve the abovementioned object, in the present invention, a pair of pressurizing faces for pressure-nipping a sheet bundle are formed to have tooth forms each having a convex shape and a concave shape, the tooth forms being engaged with each other along a predetermined tooth width, and the tooth forms are shaped so that an engagement depth between a tooth top and a tooth root is varied along a tooth width direction toward a sheet end edge.

In more detail, provided is a sheet binding processing apparatus to perform a pressure-contact binding as pressure-nipping a plurality of sheets in a front-back direction of the sheets with a pair of pressurizing faces (31, 41). The apparatus includes a pair of pressurizing members (30, 40) having the pressurizing faces, and a driving device that causes at least one of the pressurizing faces to reciprocate between a waiting position (Wp) being apart from the sheets and an operating position (Ap) for pressurizing the sheets. Here, the pair of pressurizing faces are formed to have the tooth forms (31*x*, 41*x*) each having a convex shape and a concave shape, the tooth forms being engaged with each other along the predetermined tooth width. Further, the tooth forms are shaped so that the engagement depth (dh) between a tooth top and a tooth root is varied along the tooth width direction toward the sheet end edge.

Specifically, for example, each of the pressurizing faces includes a first and second tooth form lines (Dx, Dy). Then, one of an engagement depth (dh1) of the first tooth form line and an engagement depth (dh2) of the second tooth form line is set large and the other thereof is set small. Alternatively, at least one of the pressurizing faces being a pair is inclined in the tooth width direction. Alternatively, a step (Δ) is formed at the pair of pressurizing faces.

Here, at the pressurizing faces, the engagement depth at a position being close to the sheet edge side is set large and the engagement depth at a position being close to the sheet center is set small.

According to the present invention, for binding a sheet bundle as pressure-nipping the sheet bundle in the front-back direction with the pair of pressurizing members, a convex tooth form is formed on one pressurizing face and a concave tooth form is formed on the other pressurizing face. Then, the engagement depth at the sheet center side is set different from that at the sheet edge side.

Accordingly, a strongly pressure-nipped binding part and a weakly pressure-nipped binding part are formed at the pressurized sheet bundle. The strongly pressure-nipped binding part provides reliable binding and the weakly pressure-nipped binding part provides binding without causing a damage on the sheets. For example, strong binding is provided to a binding part being close to a sheet edge side and weak binding is provided to a binding part being close to a sheet center. With this configuration, a thick sheet bundle is bound at the strong binding part. Further, a thin sheet bundle is less influenced by a sheet damage occurring at the strong binding part because the damage occurs at a position close to the sheet edge side.

That is, owing to that a sheet bundle is pressure-nipped weakly at the sheet center side and strongly at the sheet edge side, pressing force is not insufficient for a thick sheet bundle and pressing force on a thin sheet bundle does not cause a damage at the sheet center side.

BRIEF DESCRIPTION OF THE DRAWINGS

FIGS. 4A to 4C are explanatory views of an embodiment (first embodiment) of pressurizing faces of the sheet binding processing apparatus in FIG. 3, while FIG. 4A is a perspective explanatory view of the pressurizing faces, FIG. 4B illustrates tooth form shapes of a first tooth form line, and FIG. 4C illustrates tooth form shapes of a second tooth form line;

FIGS. 5A to 5C illustrate sheet bound states with the sheet binding processing apparatus in FIGS. 4A to 4C, while FIG. 5A is a plane view, FIG. 5B is a tooth form cross-sectional view of the first tooth form line, and FIG. 5C is a tooth form cross-sectional view of the second tooth form line;

FIGS. 6A to 6D are explanatory views of a second embodiment of the pressurizing faces of the sheet binding processing apparatus in FIG. 3, while FIG. 6A is a perspective view of the pressurizing faces, FIG. 6B illustrates cross-sectional shapes of tooth forms, FIG. 6C illustrates different cross-sectional shapes of the tooth forms, and FIG. 6D is a plane view of the pressurizing faces;

FIGS. 7A to 7D are explanatory views of a third embodiment of the pressurizing faces of the sheet binding processing apparatus in FIG. 3, while FIG. 7A is a perspective view of the pressurizing faces, FIGS. 7B and 7C illustrate different cross-sectional shapes of the tooth forms, and FIG. 7D is a plane view of the pressurizing faces;

FIGS. 8A and 8B are explanatory views illustrating pressure-contact binding positions of a sheet bundle, while FIG. 8A illustrates a case that the binding process is performed at a sheet corner and FIG. 8B illustrates a case that the binding process is performed along a sheet edge side; and FIGS. 9A and 9B are block diagrams, while FIG. 9A illustrates a control configuration of an image forming system and FIG. 9B is a flowchart of the binding processing operation.

DETAILED DESCRIPTION OF THE PREFERRED EMBODIMENT

Figure 1:
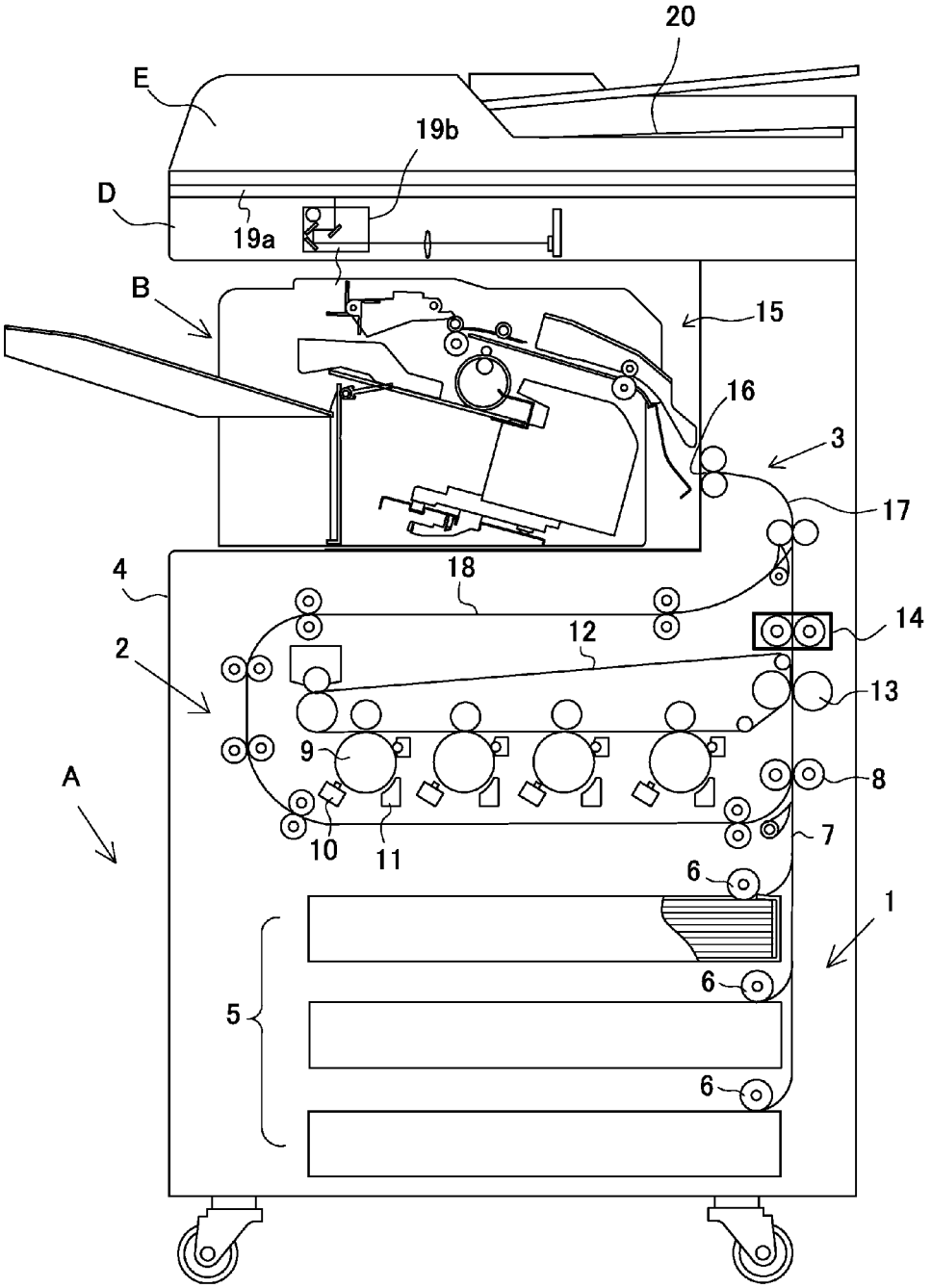
FIG. 1 is an explanatory view of a whole configuration of an image forming system having a post-processing apparatus according to the present invention.

In the following, the present invention will be described in detail based on illustrated embodiments. FIG. 1 illustrates an image forming system having a post-processing apparatus according to the present invention. The image forming system includes an image forming apparatus A that forms an image on a sheet, and a post-processing apparatus B that stores the image-formed sheets after performing a binding process thereon. The post-processing apparatus B incorporates a sheet binding processing apparatus C that performs the binding process on stacked sheets.

[Image Forming System]

Description will be provided on the image forming system that is illustrated in FIG. 1. The illustrated image forming system includes the image forming apparatus A and the post-processing apparatus B. The sheet binding apparatus C is incorporated in the post-processing apparatus B. In the following, the image forming apparatus A will be described.

The image forming apparatus A includes a sheet feeding portion 1, an image forming portion 2, a sheet discharging portion 3, and a signal processing portion (not illustrated) as being incorporated in an apparatus housing 4. The sheet feeding portion 1 includes a plurality of cassettes 5 that are capable of storing sheets having different sizes. Each of the cassettes 5 incorporates a sheet feeding roller 6 to feed a sheet and an unillustrated separating device (a separating pawl, a separating roller, or the like) to separate sheets one by one.

Further, a sheet feeding path 7 is arranged at the sheet feeding portion 1 for feeding a sheet from each cassette 5 to the image forming portion 2. A pair of resist rollers 8 are arranged at an end of the sheet feeding path 7, so that a sheet fed from each cassette 5 is aligned at a leading end thereof and causes to wait to be fed in accordance with image forming timing of the image forming portion 2.

The image forming portion 2 may adopt various image forming mechanisms to form an image on a sheet. FIG. 1 illustrates an electrostatic image forming mechanism. As illustrated in FIG. 1, a plurality of drums 9 each including a photo conductor are arranged at the apparatus housing 4 in accordance with color elements. A light emitter (laser head or the like) 10 and a developer 11 are arranged at each of the drums 9. A latent image (electrostatic image) is formed by the light emitter 10 at each of the drums 9 and toner ink is caused to adhere thereto by the developer 11. The ink images adhering on the respective belts 9 are superimposed to be an image as being transferred on a transfer belt 12 respectively with the color elements.

The transferred image formed on the transfer belt 12 is transferred by a charger 13 onto a sheet fed from the sheet feeding portion 1 and fixed by a fixing device (heating roller) 14, and then, is fed to the sheet discharging portion 3. The sheet discharging portion 3 includes a sheet discharging port 16 to discharge a sheet to a sheet discharging space 15 formed in the apparatus housing 4 and a sheet discharging path 17 to guide the sheet from the image forming portion 2 to the sheet discharging port 16. A later-mentioned duplex path 18 is continuously arranged at the sheet discharging portion 3, so that a sheet having an image formed on the front face thereof is re-fed to the image forming portion 2 after being face-reversed.

An illustrated image reading unit D includes a platen 19*a* and a reading carriage 19*b* that reciprocates along the platen 19*a*. An illustrated document feeding unit E includes a feeding mechanism to feed document sheets set on a sheet feeding tray to the platen 19*a* one by one and to store each document sheet on a sheet discharging tray 20 after each image is read.

[Post-Processing Apparatus]

Figure 2:
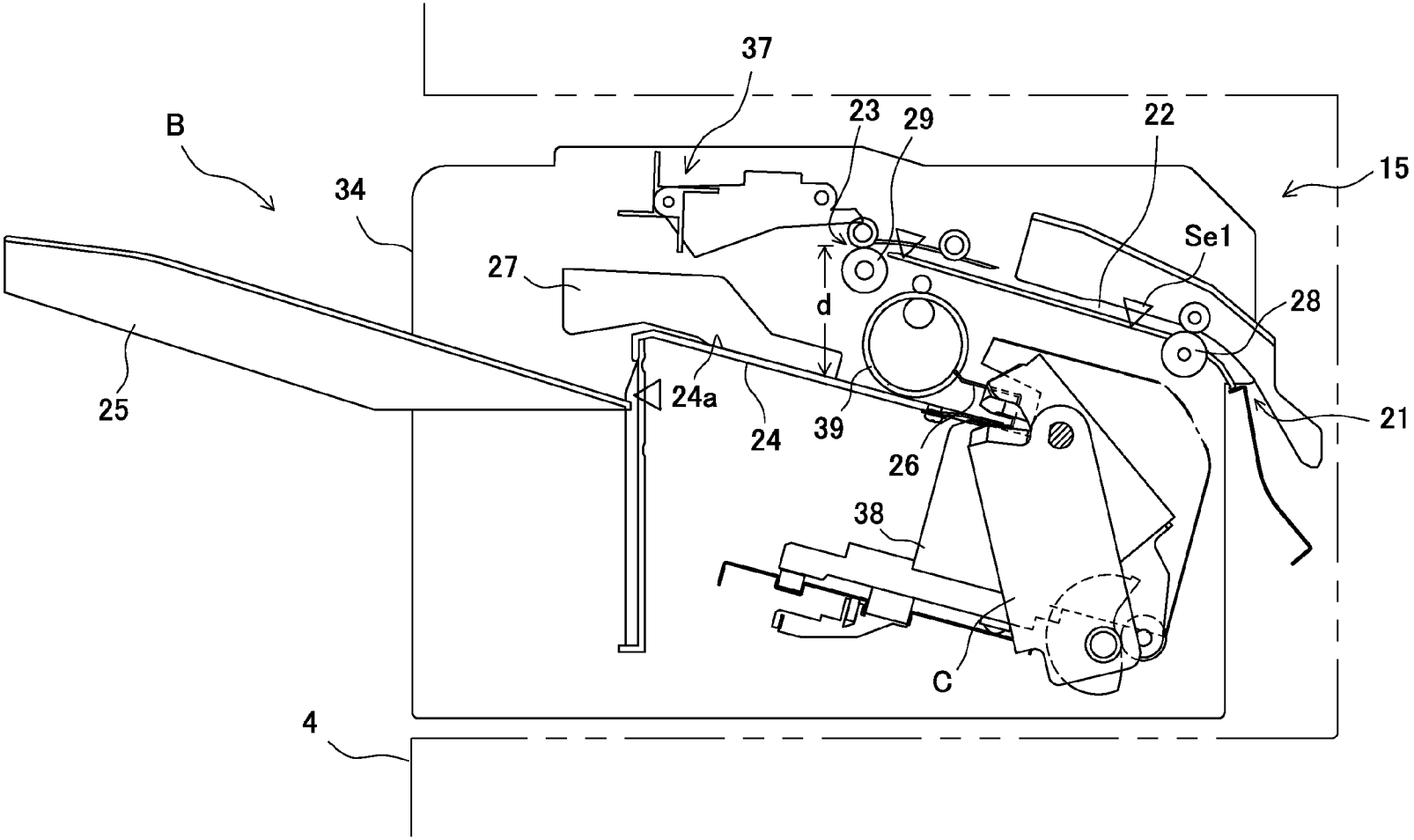
FIG. 2 is a detailed explanatory view of the post-processing apparatus of the image forming system in FIG. 1.

Next, description will be provided on the post-processing apparatus B illustrated in FIGS. 1 and 2. The binding unit (sheet binding processing apparatus, as the case may be) C is incorporated in the illustrated post-processing apparatus B as being a terminal apparatus of the image forming system.

As illustrated in FIG. 2, the post-processing apparatus B includes an apparatus housing 34, a sheet conveying path 22 arranged in the apparatus housing 34, a processing tray (sheet supporting device, as the case may be) 24 arranged at the downstream side of a discharging port 23 of the sheet conveying path 22, and a stack tray 25 arranged at the downstream side of the processing tray 24.

An introducing device 37 to introduce a sheet and a position regulating device (a sheet end regulating member 26 and a side edge aligning member 27 that are described later) to perform positioning of the introduced sheet at a predetermined post-processing position (binding position) P are arranged at the processing tray 24. A sheet binding device (pressure-contact binding device 49) to perform a binding process on a sheet bundle is arranged at the processing tray 24. The configuration of the pressure-contact binding device 49 will be described later. A staple binding device 38 to perform a binding process on sheets is arranged at the illustrated processing tray 24 along with the pressure-contact binding device 49. Sheets stacked on the processing tray 24 are bound with pressure-contact or a staple using a designated device.

As illustrated in FIG. 2, the sheet conveying path 22 having an introducing port 21 and the discharging port 23 is arranged at the apparatus housing 34. In FIG. 2, the illustrated sheet conveying path 22 is structured as receiving a sheet in the horizontal direction and discharging the sheet from the discharging port 23 after conveying approximately in the horizontal direction. The sheet conveying path 22 incorporates a conveying mechanism (a conveying roller or the like) to convey a sheet.

The conveying mechanism is structured with pairs of conveying rollers arranged at predetermined intervals in accordance with a path length. A pair of introducing rollers 28 is arranged in the vicinity of the introducing port 21 and a pair of discharging roller 29 is arranged in the vicinity of the discharging port 23. The pair of introducing rollers 28 and the pair of discharging rollers 29 are connected to the same driving motor (not illustrated) and convey a sheet at the same circumferential speed. Further, a sheet sensor Se1 to detect at least one of a leading end or a tailing end of the sheet is arranged at the sheet conveying path 22.

The processing tray 24 is arranged at the downstream side of the discharging port 23 of the sheet conveying path 22 as forming a step d therefrom. For upward stacking of sheets fed from the discharging port 23 into a bundle shape, the processing tray 24 includes a sheet placement face 24*a* that supports at least a part of the sheets. The processing tray 24 is arranged so that sheets fed from the discharging port 23 are stacked into a bundle shape, and a binding process is performed after the sheets are aligned into a predetermined posture. Subsequently, the processed sheet bundle is discharged to the stack tray 25 at the downstream side.

The sheet introducing device 37 (paddle rotor) is arranged at the discharging port 23 to convey a sheet to a predetermined position of the processing tray 24. Further, a rake-conveying device 39 to guide the leading end of the sheet to the sheet end regulating member 26 is arranged at the processing tray 24.

The rake-conveying device 39 is arranged at the upstream side of the sheet end regulating member 26. The illustrated rake-conveying device 39 is structured with a ring-shaped belt member. The belt member 39 is engaged with the upmost sheet on the sheet placement face 24*a* and rotated in a direction to convey the sheet toward the sheet end regulating member (position regulating device) 26.

The sheet end regulating member 26 to perform sheet positioning is arranged at a leading end part (in the drawing, a tailing end part in the sheet discharging direction) of the processing tray 24. The sheet end regulating member 26 performs regulation with abutting on the sheets introduced from the discharging port 23 by the rake-conveying device 39. The sheet end regulating member 26 aligns the sheets stacked on the processing tray 24 at the predetermined processing position.

Further, the side edge aligning member 27 is arranged at the processing tray 24 to perform positioning to a reference line on a sheet positioned by the sheet end regulating member 26 in the width direction thereof. The illustrated side edge aligning member 27 performs biasing and aligning, in a direction perpendicular to the sheet discharging direction, on a sheet fed from the discharging port 23 and positioned by the sheet end regulating member 26. The side edge aligning member 27 is structured with a right-left pair of aligning plates to perform positioning on a sheet at a predetermined reference line (in center reference or side reference).

The pressure-contact binding device 49 and the staple binding device 38 are arranged at the processing tray 24 to perform a binding process on sheets regulated as being abutted to the sheet end regulating member 26 and positioned in the width direction by the side edge aligning member 27. Since a sheet binding processing mechanism and a binding processing operation with the staple binding device 38 are already well-known, description thereof is skipped.

[Pressure-Contact Binding Device]

The pressure-contact binding device (sheet binding apparatus) 49 according to the present invention will be described with reference to FIG. 3. According to the pressure-contact binding device 49, a plurality of sheets stacked into a bundle shape are bound as being pressure-deformed to be mutually engaged. Here, the pressure-contact binding device 49 is structured with a clamp mechanism to clamp and deform a plurality of sheets.

The pressure-contact binding device 49 includes a pair of pressurizing faces 31, 41 that pressure-nips bundle-shaped sheets in a front-back direction, a pair of pressurizing members 30, 40 having the pressurizing faces, and a driving mechanism (driving device) PM that causes the pressurizing face of one of the pressurizing members to move from a waiting position (non-pressurizing position, as the case may be) being apart from the sheets to a pressurizing position for pressurizing the sheets. The clamp mechanism in FIG. 3 includes a fixed pressurizing member 30 having a fixed pressurizing face 31, a movable pressurizing member 40 having a movable pressurizing face 41, and the driving mechanism PM that causes the movable pressurizing face to move from the waiting position being apart from the sheets to the pressurizing position for pressurizing the sheets.

The fixed pressurizing member (hereinafter, called fixed member) 30 and the movable pressurizing member (hereinafter, called movable member) 40 are configured so that a sheet bundle supported on the pressurizing face (hereinafter, called fixed face) 31 of the fixed member 30 is clamped with the pressurizing face (hereinafter, called movable face) 41 of the movable member 40. Here, the movable member 40 is swingably axis-supported about a support shaft 42 and the support shaft 42 is fixed to the fixed member 30. Not limited to the fixed member 30, the support shaft 42 may be fixed to another member such as a unit frame.

Further, the fixed member 30 is integrally fixed to a frame unit 46. Then, with an operation of swinging motion of the movable member 40 about the support shaft 42, the fixed face 31 and the movable face 41 are positionally moved between a pressurizing state (pressurizing position) as clamping a sheet bundle and a non-pressurizing state (waiting position) as being separated (apart) from a sheet bundle.

Figure 3:
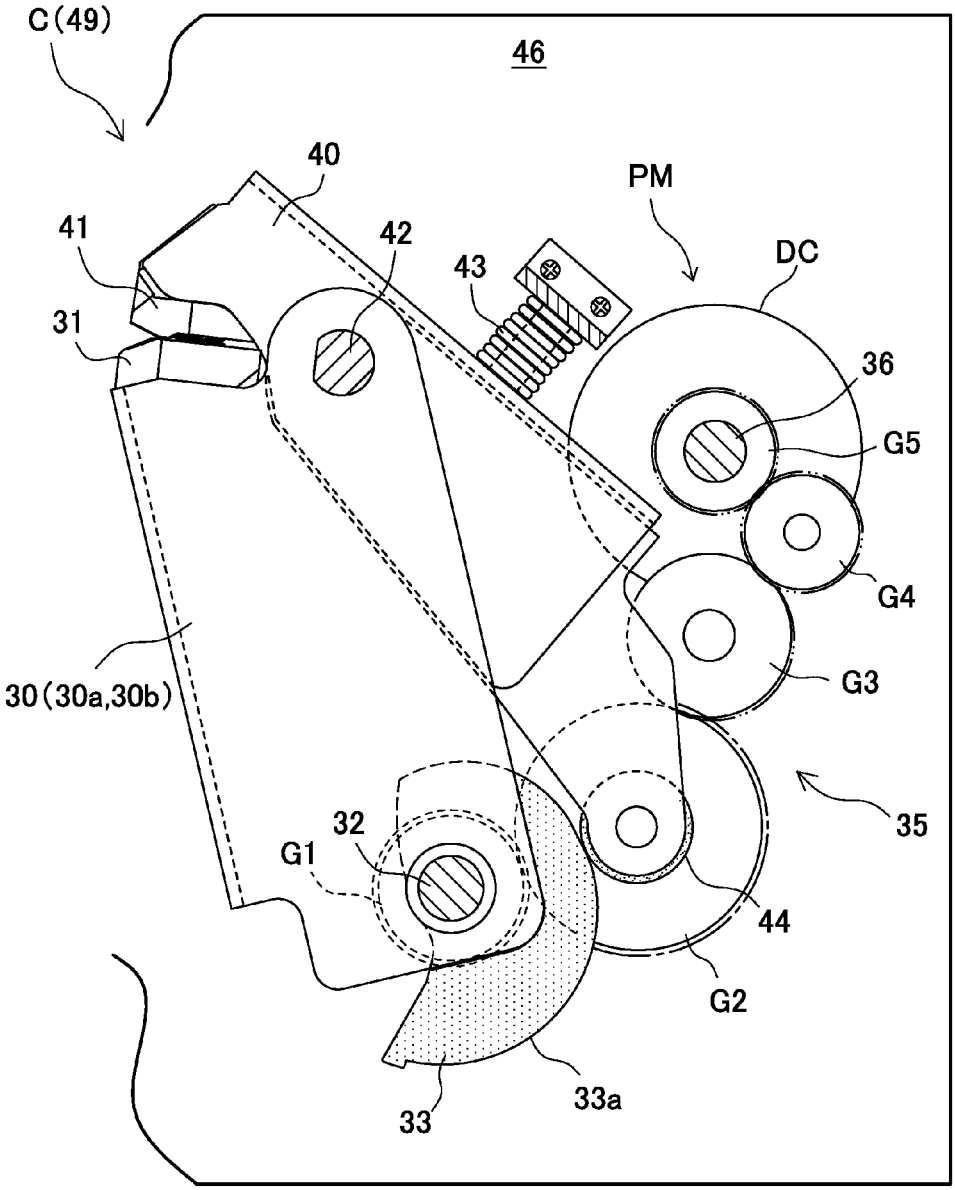
FIG. 3 is a structural explanatory view of a sheet binding processing apparatus incorporated in the post-processing apparatus in FIG. 2.

In the apparatus illustrated in FIG. 3, the fixed member 30 is structured with a frame member (made of metal, reinforced resin, or the like) having a U-shaped cross-section (channel shape). The movable member 40 is swingably supported by the support shaft 42 between side walls 30*a*, 30*b* of the fixed member 30. Thus, the movable member 40 performs swinging motion about the support shaft 42 as being guided by the side walls 30*a*, 30*b* of the fixed member 30. Further, the movable member 40 is provided with a return spring 43 to be urged toward the waiting position. The return spring 43 is arranged between the movable member 40 and the unit frame 46 (or the fixed member 30).

Figure 4A:
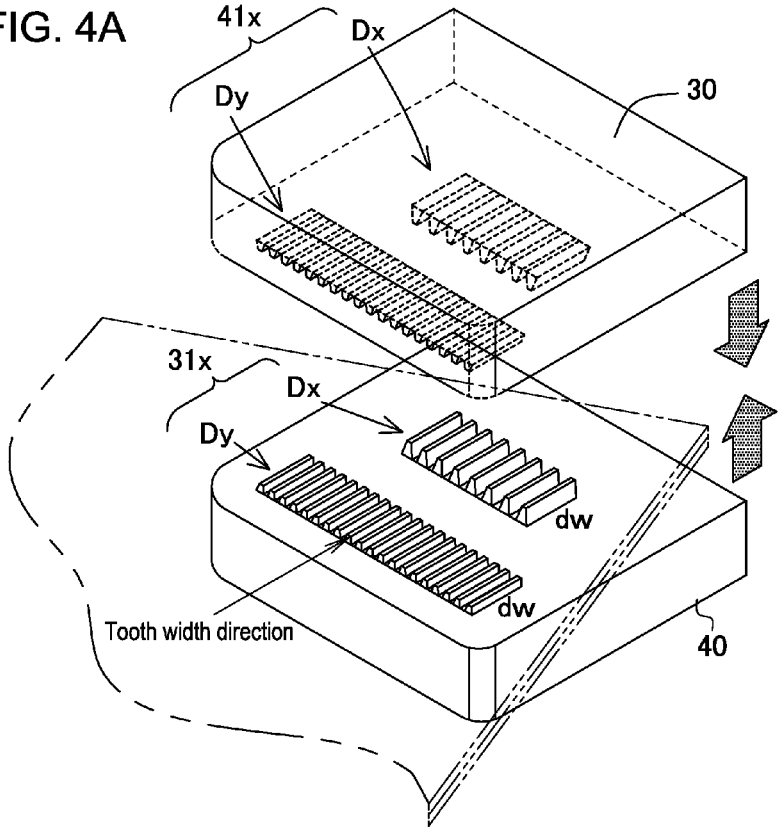
Figure 4B:
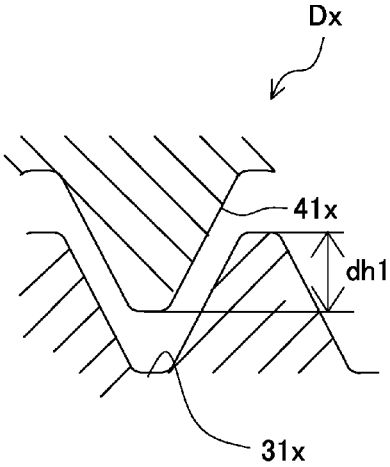
Figure 4C:
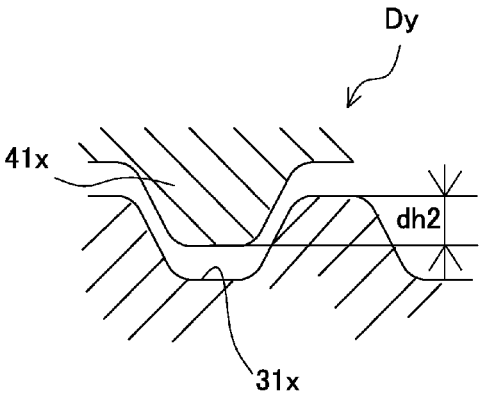

Then, a pair of pressurizing faces for pressure-nipping a sheet bundle in the front-back direction thereof are formed at the fixed face 31 and the movable face 41. As illustrated in FIGS. 4A to 4C, tooth forms (31*x*, 41*x*) each having a convex shape and a concave shape are formed on the pressurizing face 31, 41 respectively to be engaged with each other along a predetermined tooth width (w). Shapes of the tooth forms will be described later in first to third embodiments. FIGS. 4A to 4C illustrate features of tooth form shapes being common in the later-mentioned embodiments. A tooth form 41*x* having a convex shape is formed on one of the pressurizing faces 31, 41 for pressure-nipping a sheet bundle and a tooth form 31*x* having a concave shape is formed on the other thereof. The respective tooth forms are arranged to satisfy a positional relation for mutual engagement.

A plurality of the tooth forms 31*x*, 41*x* are arranged on the fixed face 31 and the movable face 41 to be mutually engaged, so that tooth form lines Dx, Dy are formed. Not being required to have the same shape, the respective tooth forms have the same shape for convenience of explanation to be gear-shaped with a tooth thickness dt, a tooth width dt, and an engagement depth dh. Then, the plurality of tooth forms are arranged continuously arranged over a predetermined length (pressure-binding length) DL, respectively. Here, pressure-binding area Pa for pressurizing a sheet bundle is obtained as "Pa=DL×dw".

Figure 8A:
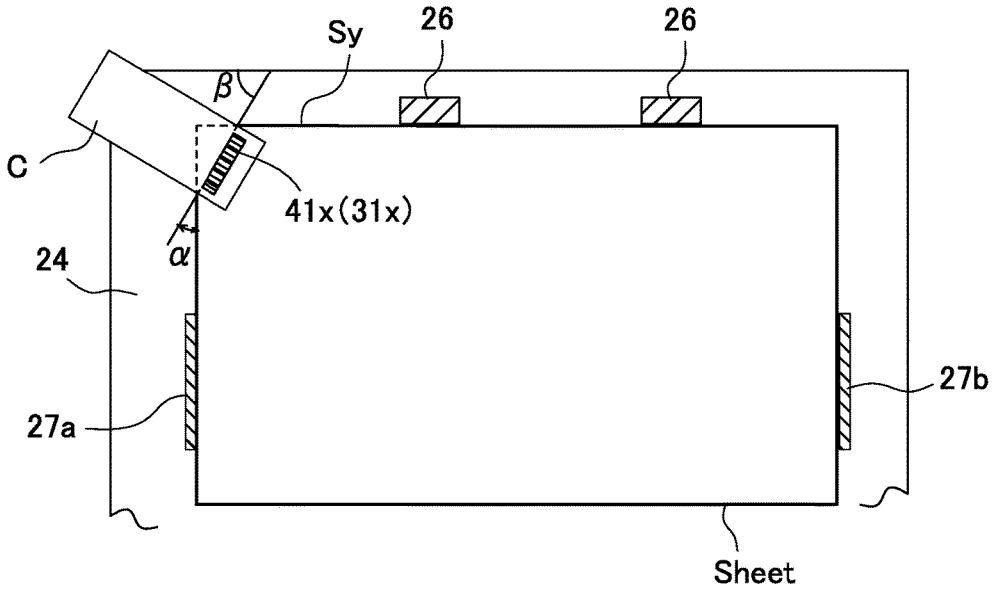
Figure 8B:
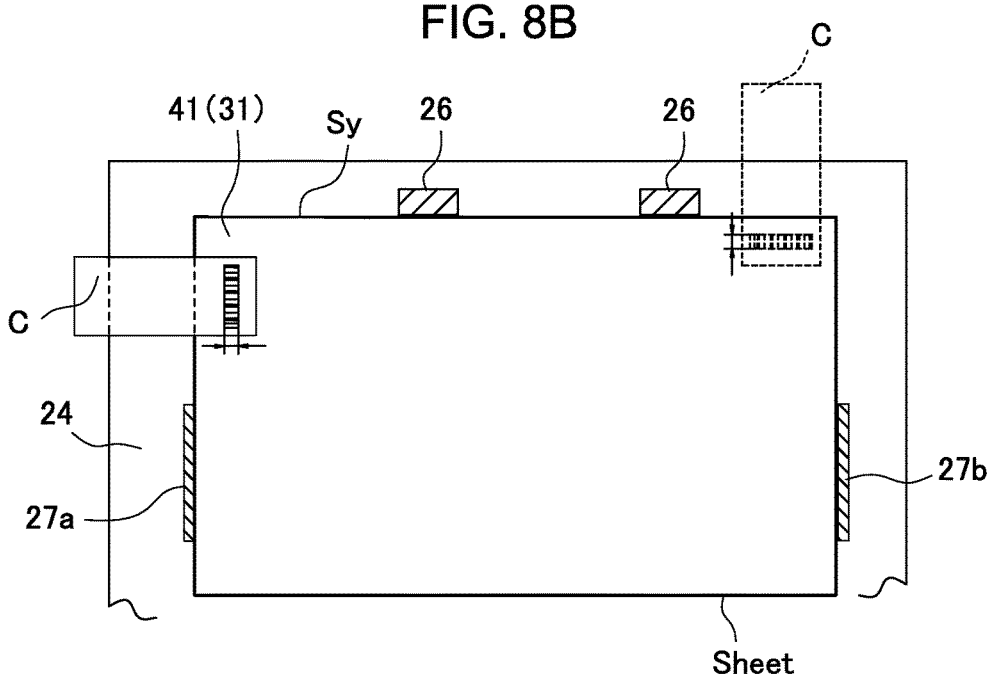

Regarding the pressure-binding area Pa, there may be a case of being oblique by a predetermined angle at a sheet corner as illustrated in FIGS. 8A and 8B (angle α from a sheet side edge and angle β from a sheet front edge, each being arbitrary), a case of being in parallel to a sheet side edge, and a case of being in parallel to a sheet front edge. In any case, each of the tooth form lines Dx, Dy is formed by arranging a plurality of tooth forms so that the tooth width direction is oriented in a direction from a sheet center toward an end edge.

In the first embodiment, the tooth form lines Dx, Dy are arranged in parallel as forming two lines or more. Here, an engagement depth dh1 of the tooth form line Dx located at the sheet edge side and an engagement depth dh2 of the tooth form line Dy located at the sheet center side are set to be different from each other (dh1>dh2). Further, in the second embodiment, the tooth form line (Dx) is arranged as forming a single line. Here, an engagement depth dh1 at the sheet edge side and an engagement depth dh2 at the sheet center side are set to be different from each other (dh1>dh2) by forming a step Δ at each of the tooth forms (dx, dy).

In the third embodiment, the tooth form line (Dx) is arranged as forming a single line. Here, inclination (inclination angle γ) is formed at each of the tooth forms (dx, dy). The inclination in this case is formed so that an engagement depth at the sheet edge side is larger than an engagement depth at the sheet center side.

The driving mechanism for the movable member 40 will be described. The movable member 40 swingably supported to the fixed member 30 includes the movable face 41 at the top end part and a cam follower 44 (hereinafter, called follower roller) at a base end part as being separated by the support shaft 42. The movable face 41 at the top end part and the follower roller 44 are arranged to form lever lengths so that leverage (boosting mechanism) functions via the support shaft 42.

Further, a cam member 33 (in the drawing, a cylindrical cam) is arranged at a base end part of the fixed member 30. The cam member 33 is supported by a cam shaft 32 and the cam shaft 32 is axis-supported rotatably to the fixed member 30. Here, the cam member 33 and the follower roller 44 are arranged to satisfy a positional relation for mutual engagement. Further, rotation of the driving motor DC is transmitted to the cam shaft 32 via a transmission device 35 so that the cam member 33 is rotated forwardly and reversely with forward and reverse rotation of the driving motor DC.

As illustrated in FIG. 3, the driving motor DC is mounted on the unit frame 46. Rotation of a driving shaft 36 of the driving motor DC is transmitted to cause rotation of the cam shaft 32 via transmission gears G2, G3, G4, G5 that structure the transmission device 35. A gear G1 connected to the camshaft 32 rotates the cam member 33 counterclockwise in FIG. 3. With the structure illustrated in FIG. 3, owing to forward and reverse rotation of the driving motor DC, the cam member 33 is repeatedly rotated counterclockwise (CCW) and clockwise (CW) within a predetermined angle range. Then, a cam face 33*a* of the cam member 33 causes the follower roller 44 and the movable member 40 being integral therewith to perform swinging motion about the support shaft 42.

The pair of pressurizing faces 31, 41 are supported by the pressurizing members (the fixed pressurizing member 30 and the movable pressurizing member 40) and move to the operating position Ap from the waiting position Wp where the pressurizing members 30, 40 are apart from each other. At that time, a sheet bundle is pressed by the pair of pressurizing faces 31, 41, so that the respective sheets are deformed to be pressure-contacted and bound. The binding of the respective sheets is achieved owing to that textile components of the respective sheets are mutually entwined and that the respective sheets are plastically deformed into a concave-convex shape in a stacked state.

Accordingly, the larger (deeper) the engagement depth (dt) of the pressurizing face (fixed face) 31 and the pressurizing face (movable face) 41 is, the larger the binding force is. On the other hand, the larger engagement depth causes larger deformation force to be applied on the sheets, so that the sheets become more likely to be damaged. In the embodiments described later, the engagement depth (dh2) at the sheet center side is set small and the engagement depth (dh1) at the sheet edge side is set large. Owing to this configuration, reliable binding can be performed on a thin sheet bundle as well as on a thick sheet bundle. Here, since damage occurring on weak sheets occurs at a position near a sheet edge side, influence thereof is small.

[First Embodiment of Pressurizing Faces]

On the pressurizing faces 31, 41 illustrated in FIGS. 4A to 4C, the first and second tooth form lines (Dx, Dy) are formed at a sheet corner. Then, the first tooth form line Dx located at the sheet edge side and the second tooth form line Dy located at the sheet center side are arranged, for example, approximately in parallel to each other or in directions not to intersect with each other. The tooth width (dw) direction of each of the tooth forms (the upper tooth form 31$x$ and the lower tooth form 41$x$) is oriented in a direction of a line (a direction of an arrow in FIG. 4A) extending from the sheet center toward the sheet edge side.

Then, the engagement depth dh1 of the tooth form line Dx located at the sheet edge side and the engagement depth dh2 of the tooth form line Dy located at the sheet center side are set to be different from each other. Here, the engagement depth dh1 of the first tooth form line Dx is set large and the engagement depth dh2 of the second tooth form line Dy is set small (dh1>dh2).

The engagement depth dh1 is set to have a shape and a depth dimension so that reliable binding is obtained even when the sheet bundle is thick and the sheet material is less likely to be deformed (elastic). Further, the engagement depth dh2 is set to have a depth dimension so that sheets are less likely to be damaged even when the sheet bundle is thin and the sheet material is weak.

According to such setting of the engagement depths of the tooth forms as described above, reliable binding can be obtained and influence of damage can be lessened with relatively wide range of sheet materials and sheet bundle thickness.

Figure 5A:
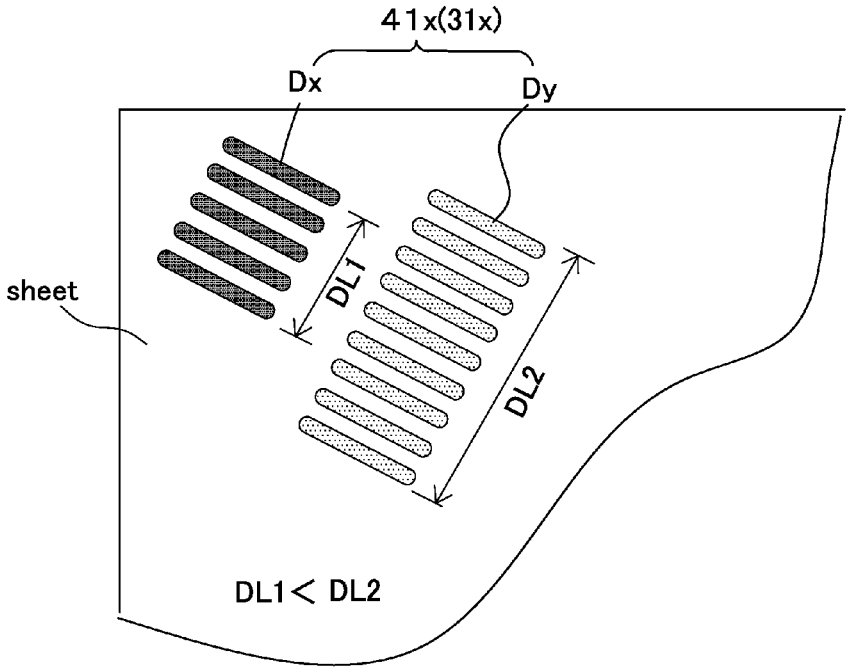
Figure 5B:
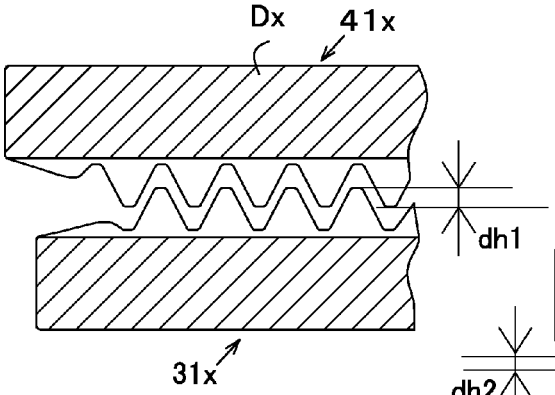
Figure 5C:
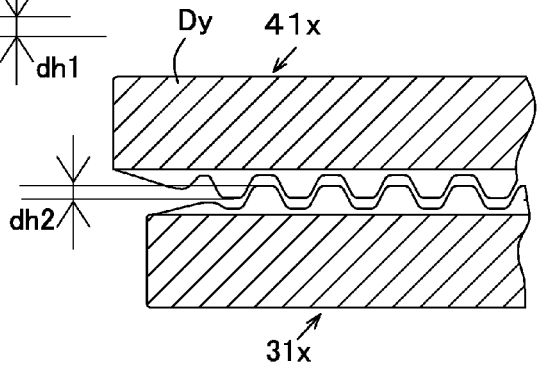

Further, regarding pressure-binding lengths DL of the first tooth form line Dx and the second tooth form line Dy in FIGS. 5A to 5C, a length DL1 of the first tooth form line Dx is set to be short and a length DL2 of the second tooth form line Dy is set to be long (DL1<DL2). That is, the tooth form line having large pressing force being apt to damage sheets is set to have a short pressurizing length and the tooth form line having small pressing force not being apt to damage sheets is set to have a long pressurizing length. Each length is set with experiments in accordance with degrees of sheet damage and binding strength.

[Second Embodiment of Pressurizing Faces]

On the pressurizing faces illustrated in FIGS. 6A to 6D, the tooth forms 31$x$, 41$x$ to be mutually engaged are arranged respectively as forming a single tooth form line Dx. The tooth width (dw) of each tooth form is oriented in a direction from the sheet center toward the sheet edge side and pressure-binding length (DL1) is set to have an appropriate length. Here, the engagement depth dh1 at the sheet edge side and the engagement depth dh2 at the sheet center side are set to be different from each other by forming the step Δ at each of the tooth forms 31$x$, 41$x$.

The step Δ is set to have a dimension so that the engagement depth dh1 at the sheet edge side is large and the engagement depth dh2 at the sheet center side is small (dh1>dh2). FIG. 6B illustrates a case that the step Δ is formed on each of the pressurizing faces 31, 41 that are faced to each other. FIG. 6C illustrates a case that the step Δ is formed only on one of the pressurizing faces 31, 41 that are faced to each other.

[Third Embodiment of Pressurizing Faces]

On the pressurizing faces illustrated in FIGS. 7A to 7D, the tooth forms 31$x$, 41$x$ to be mutually engaged are arranged respectively as forming a single tooth form line Dx. The tooth width (dw) of each tooth form is oriented in a direction from the sheet center toward the sheet edge side and pressure-binding length (DL1) is set to have an appropriate length. Here, the engagement depth dh1 at the sheet edge side and the engagement depth dh2 at the sheet center side are set to be different from each other by forming inclination (angle γ) at each of the tooth forms 31$x$, 41$x$. The inclination (γ) is set so that the engagement depth dh1 at the sheet edge side is larger than the engagement depth dh2 at the sheet center side (dh1>dh2).

FIG. 7B illustrates a case that the inclination (angle γ) is formed on each of the pressurizing faces 31, 41 that are faced to each other. FIG. 7C illustrates a case that the inclination (angle γ) is formed only on one of the pressurizing faces 31, 41 that are faced to each other.

[Control Configuration]

Next, description will be provided on a control configuration illustrated in FIGS. 9A and 9B. FIG. 9A illustrates the control configuration of the image forming system. A controller includes an image forming control portion 45 that controls the image forming unit, and a post-processing control portion 50. The image forming control portion 45 includes a mode selecting portion 48 and an inputting portion 47. The inputting portion 47 sets conditions for image forming and sets a binding processing mode. In the binding processing mode, selection is performed whether a binding process is performed with a first binding device (the staple binding device) 38 or a binding process is performed with a second binding device (the pressure-contact binding device) 49.

The post-processing control portion 50 includes a post-processing control CPU and executes a post-processing operation as loading an execution program that is stored in a ROM 53. Further, a RAM 54 stores control data such as pressurizing time Tp of the binding operation with the second binding device 49.

The control CPU 50 includes a stacking control portion 50$a$, a binding processing control portion 50$b$, and a stack control portion 50$c$. The stacking control portion 50$a$ collates and stacks sheets fed from the image forming apparatus A onto the processing tray 24. When a first binding processing mode is selected, the binding processing control portion 50$b$ controls the stapler binding device 38 to perform the binding operation. When a second binding processing mode is selected, the binding processing control portion 50$b$ controls the pressure-contact binding device 49 to perform the binding operation. Here, the binding processing control portion 50$b$ is connected to a driver 51 of the driving motor DC of the pressure-contact binding device 49 to transmit a command signal thereto.

Description will be provided on the binding processing operation on a sheet bundle with the control CPU 50. As illustrated in FIG. 9B, after apparatus power is turned on (St01), an initialization operation is performed (St02). Then, an operator performs setting of image forming conditions and setting of the binding processing mode (St03). Subsequently, the control CPU 50 forms an image on a sheet and discharges the sheet to the post-processing apparatus B (St04). In the post-processing apparatus B, the sheet fed from the image forming apparatus A is conveyed onto the processing tray 24 and stacked into a bundle shape (St05).

When a job completion signal is received from the image forming apparatus A (St06), the control CPU 50 performs the binding processing operation (St07). After the binding process is completed, the sheet bundle is stored on the stack tray 25 (St08).

The invention claimed is:

1. A sheet binding processing apparatus to perform a pressure-contact binding as pressure-nipping a plurality of sheets in a front-back direction of the sheets with a pair of pressurizing faces, comprising:

a pair of pressurizing members having the pressurizing faces; and a driving device that causes at least one of the pressurizing faces to reciprocate between a waiting position being apart from the sheets and an operating position for pressurizing the sheets, wherein the pair of pressurizing faces are formed to have tooth forms each having a convex shape and a concave shape, the tooth forms being engaged with each other along a predetermined tooth width, and the tooth forms are shaped so that an engagement depth between a tooth top and a tooth root is varied along a tooth width direction toward a sheet end edge.

2. The sheet binding processing apparatus according to claim 1, wherein a plurality of tooth forms are arranged at each pressurizing face in a line with each tooth width direction oriented to a sheet end edge.

3. The sheet binding processing apparatus according to claim 2, wherein a first tooth form line arranged at a sheet end edge side and a second tooth form line arranged at a sheet center side are formed at each pressurizing face, and an engagement depth of the first tooth form line and an engagement depth of the second tooth form line are different from each other.

4. The sheet binding processing apparatus according to claim 1, wherein at least one of the pressurizing faces formed at the pair of pressurizing members is inclined in the tooth width direction.

5. The sheet binding processing apparatus according to claim 1, wherein a step is formed in the tooth width direction at least on one of the pressurizing faces.

6. The sheet binding processing apparatus according to claim 1, wherein the tooth forms on the pair of pressurizing faces are shaped so that an engagement depth at a sheet end edge side is larger than an engagement depth at a sheet center side.

7. The sheet binding processing apparatus according to claim 2, wherein a first tooth form line arranged at a sheet end edge side and a second tooth form line arranged at a sheet center side are formed at each pressurizing face, and a length of the first tooth form line is shorter than a length of the second tooth form line.

8. A post-processing apparatus, comprising:

a processing tray on which sheets fed from the upstream side are stacked and stored;

a sheet binding processing unit arranged at the processing tray; and a stack tray on which sheets discharged from the processing tray are stored, wherein the sheet binding processing unit is the sheet binding processing apparatus according to claim 1.

* * * * *